United States Patent [19]

Mitzlaff

[11] 4,036,712

[45] July 19, 1977

[54] PROCESS FOR PREPARING N-(α-ALKOXYETHYL)-CARBOXYLIC ACID AMIDES

[75] Inventor: Michael Mitzlaff, Bad Homburg, Taunus, Germany

[73] Assignee: Hoechst Aktiengesellschaft, Frankfurt am Main, Germany

[21] Appl. No.: 651,693

[22] Filed: Jan. 23, 1976

[30] Foreign Application Priority Data

Jan. 25, 1975 Germany ..... 2503114
Sept. 6, 1975 Germany ..... 2539767

[51] Int. Cl.[2] ..... C25B 3/10
[52] U.S. Cl. ..... 204/59 R; 204/72
[58] Field of Search ..... 204/59 R, 72, 73 R

[56] References Cited

U.S. PATENT DOCUMENTS

| | | | |
|---|---|---|---|
| 3,140,276 | 7/1964 | Forster | 204/59 R |
| 3,193,476 | 7/1965 | Baiger | 204/73 R |
| 3,459,643 | 8/1969 | Ross et al. | 204/59 |

FOREIGN PATENT DOCUMENTS

| | | | |
|---|---|---|---|
| 2,113,338 | 9/1972 | Germany | 204/59 R |

*Primary Examiner*—F.C. Edmundson
*Attorney, Agent, or Firm*—Curtis, Morris & Safford

[57] ABSTRACT

N-α-alkoxyethyl carboxylic compounds of the formula wherein $R^5$ means hydrogen, an alkyl group having from 1 to 6 carbon atoms or an aryl group having from 6 to 10 carbon atoms, especially hydrogen or a methyl group, and wherein $R^6$ means an alkyl group having from 1 to 6 carbon atoms, especially a methyl group, are prepared by electrolysis of secondary N-ethylcarboxylic acid amides of the formula with alcohols of the formula $R^6OH$, $R^5$ and $R^6$ having the aforesaid meaning, while employing tetraalkyl ammonium tetrafluoroborates, tetraalkyl ammonium hexafluorophosphates as well as alkali-tetrafluoroborates as conducting salts and a current quantity of at least 2.5 Faraday/mole of N-ethylcarboxylic acid amide.

The N-α-alkylethyl compounds are valuable intermediate products for the preparation of N-vinyl carboxylic acid amides which may then be converted to water-soluble polymers having multiple properties for technical application.

10 Claims, 1 Drawing Figure

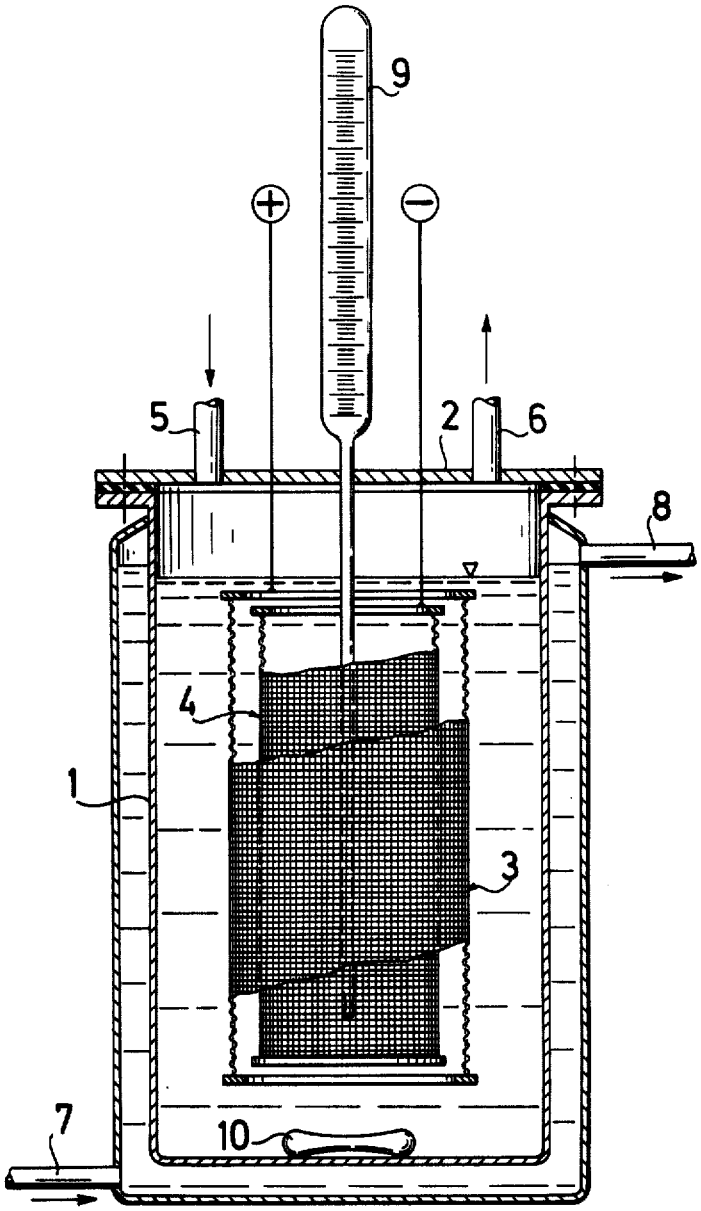
9
5
2
6
8
4
1
3
7
10

PROCESS FOR PREPARING N-(α-ALKOXYETHYL)-CARBOXYLIC ACID AMIDES

A known processing method is the electrochemical conversion of carboxylic acid amides, being alkylated on the nitrogen atom, by reaction with alcohols to yield the corresponding N-α-alkoxyalkyl carboxylic acid amides (German Offenlegungsschrift 2,113,338). This operation comrises the electrolysis at temperatures of from +10° to 100° C, in the presence of a conducting salt, of carboxylic acid amides alkylated on the nitrogen atom and having the general formula (I)

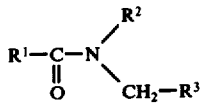

(I)

wherein $R^1$ is hydrogen, an alkyl group having from 1 to 6 carbon atoms or an aryl group having from 6 to 10 carbon atoms, $R^2$ is hydrogen or an alkyl group having from 2 to 6 carbon atoms or $R^1$ and $R^2$ are connected by an alkylene group having from 2 to 6 carbon atoms or an alkyl-substituted alkylene group having from 2 to 6 carbon atoms and alkyl groups having from 1 to 4 carbon atoms, $R^3$ means hydrogen or an alkyl group having from 1 to 6 carbon atoms, with alcohols of the general formula (II)

$$R^4(OH)_n \qquad \text{(II)}$$

wherein $R^4$ represents an alkyl group or an alkylene group having from 1 to 6 carbon atoms or a cycloalkyl group or a cycloalkylene group having from 4 to 7 carbon atoms and wherein $n$ is 1 or 2.

As conducting salts are employed especially those the cation of which contains the ammonium ion, an alkali ion, an alkali earth metal ion or a tetraalkyl ammonium ion with alkyl groups having from 1 to 6 carbons atoms, the nitryl ion or nitrosyl ion, and the anion of which contains the nitrate ion or chloride ion, oxygen in the complex-bound state with P, Cl, Br or I as the central atom, or F in the complex-bound state with P, B, Ti, Sb, As, Sn or Si as the central atom. Thus especially cited as conducting salts are ammonium nitrate, alkali nitrate, ammonium hexafluorophosphate, alkali hexafluorophosphate, ammonium and alkali hexafluorotitanate, -hexafluorosilicate, -hexafluoroantimonate, -hexafluoroarsenate, -tetrafluoroborate, -trifluorostannate and -perchlorate, tetraalkyl ammonium tetrafluoroborate and tetraalkyl ammonium chloride with alkyl groups having from 1 to 6 carbon atoms.

The above-identified German Offlegungsschrift states that due to the formation of product the cell tension increases, while the material and energy efficiency rates decrease, so that it is more convenient that the electrolysis not be carried through to the complete conversion of the reactants. For this reason, when performing this process according to said German Offenlegungsschrift, there are only applied current quantities of not more than 2.4 Faraday per mole of carboxylic acid amide.

In further pursuance of the novel idea on which the subject matter of said German Offenlegungsschrift is based, it has been found that when using a very special kind of starting compound and specific conducting salts from the group of the compounds specified in said German Offenlegungsschrift higher current quantities may be sent through the reaction batch without decreasing the material efficiency; even better, an extraordinary increase of the material efficiency may be achieved here. This increase of the material efficiency brings about the further advantage that it is much easier then to work up the reaction batch, for in that case the starting product has disappeared either completely or except for a minor residue. Therefore, the subject of the present invention is a process for the electrochemical alkoxylation of secondary N-ethylcarboxylic acid amides of the general formula (IV)

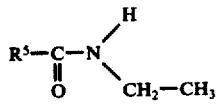

(IV)

wherein $R^5$ means hydrogen, an alkyl group having from 1 to 6 carbon atoms or an aryl group having from 6 to 10 carbon atoms, especially H or a methyl group, by means of an electrolysis with alcohols of the general formula (V)

$$R^6OH \qquad \text{(V)}$$

wherein $R^6$ means an alkyl group having from 1 to 6 carbon atoms, especially a methyl group, in the presence of quaternary ammonium salts and/or alkali salts as conducting salts to yield N-α-alkoxy-ethylcarboxylic acid amides of the formula (VI)

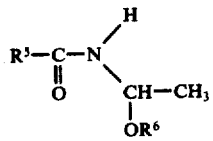

(VI)

wherein $R^5$ and $R^6$ have the aforesaid meanings. The process comprises applying a current quantity of at least 2.5 Faraday/mole of N-ethyl-carboxylic acid amide (IV). Tetraalkyl ammonium tetrafluoroborates and/or -hexafluorophosphates, wherein alkyl is of from 1 to 6 carbon atoms, are used as quaternary ammonium salts and alkali salts of tetrafluoroboric acid are used as alkali salts.

Suitable starting materials for N-ethylcarboxylic acid amide (IV) are, for example, N-ethyl formamide, N-ethyl acetamide, N-ethyl propionamide, N-ethyl butyramide, N-ethyl-n-heptylic acid amide, N-ethylbenzamide, etc. Preference is given to the use of N-ethyl formamide and N-ethyl acetamide.

Suitable alcohols (V) are methanol, ethanol, n-propanol, isopropanol, n-butanol, sec.-butanol, n-hexanol etc. Preference is given to the use of methanol or ethanol, especially of methanol.

The conducting salts employed for the electrolysis process according to the invention are tetraalkyl ammonium tetrafluoroborates and -hexafluorophosphates as well as alkali tetrafluoroborates. Suitable alkyl groups in the tetraalkyl ammonium salts are especially those having from 1 to 6 carbon atoms, preferably methyl groups and ethyl groups, tetramethyl ammonium salts being especially preferred. The following tetraalkyl ammonium salts may be cited as examples: tetramethylammoniumm tetrafluoroborate, tetraethyl ammonium tetrafluoroborate tetraethyl ammonium hexafluorophosphate, tetra-(n-butyl)-ammonium hexafluorophosphate etc. As far as alkali tetrafluoroborates are concerned there may be used, on principle, all alkali salts which may be formed with tetrafluoroboric acid. Preference is given to the use of tetramethyl ammonium, tetraethyl ammonium borate, sodium-tetrafluoroborate, and potassium-tetrafluoroborate as conducting salts, especially to the use of tetramethyl ammonium tetrafluoroborate. The conducting salts may be employed separately as well as mixtures.

The concentration of conducting salt in the electrolysis solution should be from about 0.01 to about 2.0 mole/l, preferably from about 0.02 to about 1.0 mole/l.

The electrochemical alkoxylation according to the invention may be carried out discontinuously or continously as well.

The electrolysis during a discontinuous process may be performed for example in the electrolysis cell 1 illustrated by the drawing. This cell is equipped with a tightly sealing cover-lid 2, through which are led the power supply lines for the electrodes 3 and 4, and in which are fitted the openings 5 for the supply of the electrolysis solution, 6 for the discharge of gas and for a thermometer 9. The orifice for the discharge of gas may be equipped with a reflux cooler, in which evaporating portions of the electrolysis mixture may be recovered by condensation. The electrolysis cell is encased and may be connected to a heating or cooling liquid circuit by means of inlet 7 and outlet 8 sockets. The temperature of the electrolysis solution is controlled by a thermometer 9 and a thermosensor. The two electrodes 3 (anode) and 4 (cathode) are set up at a distance of from 0.5 to 50 mm, preferably from 1 to 15 mm. The electrodes are made up as nets or sheets of palladium or platinum or as noble metal-coated metal electrodes, preferably titanium electrodes, or mixed oxide coated metal electrodes (as anodes), preferably titanium anodes. The embodiment of the electrodes as nets is especially advantageous, because the discharge of the gaseous hydrogen formed during the electrolysis is facilitated and the uniform and thorough mixture of the electrolysis solution is additionally favored by the gas current being formed on that occasion. The vertical disposition of the electrodes may be replaced by a horizontal disposition. The installation of several electrode pairs is also possible. This proved to be especially efficient in the case of a block-like combination of angular or non-angular capillary split electrodes, the electrodes either vibrating or not. The solution is mixed vigourously during the electrolysis by means of an agitator, for example a magnetic stirrer 10, or by means of circulation by pumping, especially in the case of the block-like combinations.

If the process is carried out continuously, an additional orifice is set in the cover-lid 2 of the electrolysis vessel 1 to allow the electrolysis solution to circulate by pumping continuously. A portion of the electrolysis solution which circulates by pumping is separated for a work-up of the product. After the electrolysis solution is submitted to a determination of the content based on the ratio of the desired reaction product to the starting material, e.g. determination based on a nuclear magnetic resonance spectrum, the solution is then worked-up in known manner. The starting materials, being recovered upon distillation, are adjusted to the molar ratio employed and then metered into the continuously recirculating electrolysis solution together with the required quantity of the conducting salt. The electrolysis is usually carried out under normal pressure, but may as well be performed under reduced pressure.

To avoid the formation of explosive gas mixtures of hydrogen and air, the addition of an inert gas such as nitrogen is beneficial.

The electrolysis solution according to the invention consists of an alcoholic solution of an N-monoethyl carboxylic acid amide, the molar ratio of N-monoethyl carboxylic acid amide to alcohol being about 1 to 1 up to 1 to 100, preferably about 1 to 2 up to 1 to 60, especially about 1 to 5 up to 1 to 50, in which a conducting salt is dissolved.

The conducting salt is added after having prepared the alcoholic solution. However, this order may be modified as well.

There is no need to exclude water absolutely from the electrolysis since minor portions of humidity do not harm the reaction course according to the invention.

The energy or material efficiency of the process may be pushed to maximum results by increasing extremely the conversion rate of N-monoethyl carboxylic acid amide, e.g. to more than 99%, this step being also advantageous for a better work up of the electrolysis solution. Therefore, the electrolysis is generally continued until practically the total product is formed so that there is no need later to separate same from the reaction product.

The electrolysis current is switched off after the intended current quantity has been introduced and the electrolysis discharge is freed from the conducting salt and worked-up in known manner, preferably by distillation. The degree of purity of the reaction product of the electrolysis may be determined by a nuclear magnetic resonance spectrum.

The operating temperature for the electrolysis is chosen so as to remain below the boiling temperature of the alcohol and above the melting point of the electrolysis solution. Temperatures of from $-10°$ to $+100°$ C, preferably from 0° to 60° C are generally applied.

The current density remains within 2 to 100 A/dm$^2$, preferably 4 to 80 A/dm$^2$. Lower current densities are also possible, though these diminish the speed at which the product is formed.

The N-α-alkoxy ethyl carboxylic acid amides prepared according to the electrochemical process of the invention are valuable intermediate products for the preparation of N-vinyl carboxylic acid amides which can be converted to water-soluble polymers having multiple properties for technical application (cf. Ullmann's Encyclopadie der Techn. Chemie, 3rd edition, vol. 14, pp. 261–264). The following examples and drawing illustrates the invention:

EXAMPLE 1

Into an electrolysis cell, according to the drawing, having a volume of about 380 ml and equipped with a cover-lid and a reflux-cooler a mixture was charged which was composed of 91.4 g of N-ethylformamide and 200.3 g of methanol, in which 2.45 g of tetramethyl ammonium tetrafluoroborate are dissolved as conducting salt. Three concentrically placed platinum net cylinders having 225 meshes per cm$^2$ and a 15, 30, or 50 mm diameter and 100 mm height were plunged into the solution as electrodes. The outer and inner electrodes were connected parallelly and acted as anode, the cathode being set up midway between both. The temperature was maintained at 40° C during the electrolysis. Stirring was performed by a magnetic stirrer at from 30 to 35 revolutions per minute. After switch-on of the electrolysis direct current, the anode current density was 5 A/dm². The current was switched off after a current density of 7.075 Faraday per mole of N-ethylformamide had passed. The calculated average cell tension was 18.7 volts.

A work up of the electrolysis solution in known manner produced 95.0 g of N-(α-methoxyethyl)-formamide (boiling point 66–67° C/ 1.3 mbar; $n_D^{25}$ = 1.4370). These figures represent a material efficiency of 73.7% and a current efficiency of 20.8%. With the current quantity increasing, the current efficiency reached a value below that of the material efficiency, as could be expected.

Examples 6 and 7 of German Offenlegungsschrift 2,113,338, which also describe the electrolysis of N-ethyl formamide with $CH_3OH$, but by means of only about 2.4 (example 6) or 2 (example 7) Faraday per mole of acid amide and by utilizing different conducting salts ($NH_4NO_3$ or $KPF_6$) achieve a material efficiency of only 40.7 (example 6) or 52.1% of the theoretical yield.

EXAMPLE 2

131.5 g (1.8 mole) of N-ethylformamide and
288.4 g (9.0 mole) of methanol were submitted to an electrolysis in the same manner as described in Example 1, in the presence of 2.90 g (0.018 mole) of tetramethylammonium tetrafluoroborate as conducting salt. In this example, however, the current was switched off as soon as a current quantity of 4.073 Faraday per mole of N-ethylformamide has passed through. The calculated average cell tension was 19.2 volts.

The work up of the electrolysis solution yielded 160.2 g (1.554 mole) of N-(α-methoxyethyl)-formamide. This figure represented a material efficiency of 86.3% and a current efficiency of 42.3%.

EXAMPLE 3

A mixture of
10.54 g (0.121 mole) of N-ethylacetamide and
38.77 g (1.21 mole) of methanol was charged into an electrolysis cell according to the drawing, having a volume of about 70 ml, and equipped with a cover-lid and a reflux cooler. 1.95 g (0.121 mole) of tetramethyl ammonium tetrafluoroborate were dissolved in said mixture as conducting salt. The temperature was maintained at 40° C during the electrolysis. Stirring was performed by a magnetic stirrer at from 30 to 35 revolutions per minute. After switching-on the electrolysis current, the anode current density was 5 A/dm². After passage of a current quantity of 3 Faraday per mole of N-ethyl-acetamide, the current was switched off. The calculated average cell tension was 32.3 volts. After work up of the electrolysis solution in known manner a quantity of 12.3 g of N-(α-methoxyethyl)-acetamide was obtained (boiling point 71 to 73° C/0.9 mbar). This result represented a material efficiency of 86.8% and a current efficiency of 57.8%.

EXAMPLE 4

63.2 g of N-ethylacetamide and
232.6 g of methanol were submitted to electrolysis in the same way as per example 3, in an electrolysis cell of about 380 ml of volume, and in the presence of 1.95 g of tetramethyl ammonium tetrafluoroborate as conducting salt. In this case, however, the current quantity led through the cell was doubled to be 6.0 Faraday per mole of N-ethylacetamide. The calculated average cell tension was 19.0 volts. The work-up of the electrolysis solution in known manner produced 71.2 g of N-(α-methoxyethyl)acetamide, representing a material efficiency of 83.7% and a current efficiency of 27.9%. Even though the current quantity led through was increased from 3 to 6 Faraday per mole of N-ethylacetamide, the material efficiency did not decrease, but is remained stable. The current efficiency decreased however, as could be expected.

EXAMPLE 5

A mixture of
9.5 g of N-ethylformamide and
48.2 g of n-butanol was charged into an electrolysis cell, according to the drawing, having a volume of about 70 ml and equipped with cover-lid and reflux cooler. In said mixture 4.38 g of tetra-n-butylammonium tetrafluoroborate were dissolved as conducting salt. Two platinum net cylinders of concentric disposition having 225 meshes per cm², a 15 to 30 mm diameter and a 50 mm height, were plunged into the solution as electrodes. The outer electrode acted as anode, the inner one as cathode. Stirring was performed by a magnetic stirrer at from 30 to 35 revolutions per minute. After switching on the electrolysis direct current, the anode current density was 5 A/dm². The temperature is maintained at 40° C during the electrolysis operation.

The current was switched off after a passage of a current quantity of 5.34 Faraday per mole of N-ethylformamide. The calculated average cell tension was 39.1 Volt.

After working up the electrolysis solution in known manner, there was obtained 8.3 g of N-(α-n-butoxyethyl)-formamide (boiling point 75° C/0.1 mbar $n_D^{25}$ = 1.4328), representing a material efficiency of 44.0% and a current efficiency of 16.5%.

EXAMPLE 6

A mixture of
23.3 g of N-ethylpropionic acid amide and
36.9 g of methanol was charged into an electrolysis cell according to Example 5, wherein 0.37 g of tetramethyl ammonium tetrafluorobroate were dissolved as conducting salt. After switching on the electrolysis current, the anode current density was 2 A/dm². The temperature was maintained at 40° C during the electrolysis. Agitation was performed by a magnetic stirrer at from 30 to 35 revolutions per minute. After the passage of a current quantity of 4.06 Faraday per mole of N-ethylpropionic acid amide, the current was switched off. The calculated average cell tension was 54.9 volts. After work up of the electrolysis solution in known manner there were obtained 24.4 g of N-(α-methoxyethyl)-propionic acid amide (melting point 29°–32° C, $n_D^{35}$ = 1.4333), representing a material efficiency of 80.7% and a current efficiency of 40.4%.

EXAMPLE 7

A mixture of 18.3 g of N-ethylformamide and
40.1 g of methanol
was charged into an electrolysis cell according to Example 5, wherein 0.83 g of tetra-n-propyl ammonium hexafluorophosphate were dissolved as conducting salt. After switching on the electrolysis current, the anode current density was 5 A/dm². The temperature was maintained at 40° C. Agitation is performed by a magnetic stirrer at from 30 to 35 revolutions per minute. After the passage of a current quantity of 6 Faraday per mole of N-ethylformamide, the current was switched off. The calculated average cell tension was 34.2 volts. After work-up of the electrolysis solution in known manner there were obtained 19.6 g of N-(α-methoxyethyl)-formamide, representing a material efficiency of 76.0% and a current efficiency of 25.3%.

EXAMPLE 8

A mixture of
18.3 g of N-ethylformamide and
40.1 g of methanol
was charged into an electrolysis cell according to Example 5, wherein 0.28 g of sodium tetrafluoroborate were dissolved as conducting salt. After switching on the electrolysis current, the anode current density was 5 A/dm². The temperature is maintained at 40° C. Agitation was performed by a magnetic stirrer at from 30 to 35 revolutions per minute. After the passage of a current quantity of 5.3 Faraday per mole of N-ethylformamide, the current was switched off. The calculated average cell tension was 35.8 volts. After work up of the electrolysis solution there were obtained 18.2 g of N-(α-methoxyethyl)-formamide, representing a material efficiency of 70.6% and a current efficiency of 26.8%.

EXAMPLE 9

A mixture of
16.6 g of N-ethylacetamide and
61.2 g of methanol
were charged into an electrolysis cell according to Example 5, wherein 0.94 g of sodium tetrafluoroborate were dissolved. After switching on the electrolysis current, the anode current density was 2 A/dm². The temperature is maintained at 40° C. Agitation was performed by a magnetic stirrer at from 30 to 35 revolutions per minute. After the passage of a current quantity of 3.5 Faraday per mole of N-ethylacetamide, the current was switched off. The calculated average cell tension was 9.8 volts. After work up of the electrolysis solution there were obtained 14.7 g of N-(α-methoxyethyl)-acetamide, representing a material efficiency of 65.7% and a current efficiency of 37.5%.

EXAMPLE 10

A mixture of
16.6 g of N-ethylacetamide and
61.2 g of methanol
was charged into an electrolysis cell according to Example 1, wherein 1.20 g of potassium tetrafluoroborate were dissolved. After switching on the electrolysis current, the anode current density was 2 A/dm². The temperature is maintained at 40° C. Agitation was performed by a magnetic stirrer at from 30 to 35 revolutions per minute. After the passage of a current quantity of 3.4 Faraday per mole of N-ethylacetamide, the current was switched off. The calculated average cell tension was 36.8 volts. After work up of the electrolysis solution there were obtained 19.2 g of N-(α-methoxyethyl)-acetamide, representing a material efficiency of 85.9% and a current efficiency of 50.5%.

What is claimed is:

1. In a process for the alkoxylation of a secondary N-ethylcarboxylic acid amide of the formula

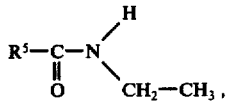

wherein $R^5$ is hydrogen, alkyl of from 1 to 6 carbon atoms or aryl of from 6 to 10 carbon atoms, by electrolysis with an alcohol of the formula $R^6$—OH wherein $R^6$ is alkyl of from 1 to 6 carbon atoms, in the presence of a quaternary ammonium salt, an alkali salt or a combination thereof, to yield an N-α-alkoxyethyl compound of the formula

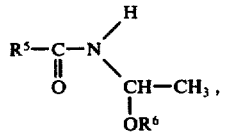

the improvement which comprises electrolysis by a current quantity of at least 2.5 Faraday/mole of acid amide in the presence of an alkali salt of tetrafluoroboric acid, a tetraalkyl ammonium tetrafluorobroate, a tetraalkyl ammonium hexafluorophosphate or a combination thereof, sais alkyl being of 1 to 6 carbon atoms.

2. The process as defined in claim 1, wherein $R^5$ is hydrogen, methyl or ethyl and $R^6$ is methyl or n-butyl.

3. The process as defined in claim 2, wherein $R^5$ is hydrogen or methyl and $R^6$ is methyl.

4. The process as defined in claim 1, which comprises electrolysis in the presence of tetramethyl ammonium tetrafluoroborate, tetra-n-butyl ammonium tetrafluoroborate, tetra-n-propyl ammonium hexalfuorophosphate, sodium tetrafluoroborate or potassium tetrafluoroborate.

5. The process as defined in claim 4 which comprises electrolysis in the presence of tetramethyl ammonium tetrafluoroborate, tetraethyl ammonium tetrafluoroborate, sodium tetrafluoroborate, or potassium tetrafluoroborate.

6. The process as defined in claim 1, which comprises electrolysis in the presence of tetraalkyl ammonium tetrafluoroborate.

7. The process as defined in claim 1, wherein said alkali salt of tetrafluoroboric acid, tetraalkyl ammonium tetrafluoroborate, tetraalkyl ammonium hexafluorophosphate or combination thereof is present in a concentration of about 0.01 to 2.0 moles per liter.

8. The process as defined in claim 7, which comprises electrolysis at a temperature of −10° to 100° C.

9. The process as defined in claim 8, which comprises electrolysis at a temperature of about 0°to 60° C.

10. The process as defined in claim 8, wherein there is current density of 2 to 100 A/dm².

* * * * *